US005241321A

United States Patent [19]

Tsao

[11] Patent Number: 5,241,321

[45] Date of Patent: Aug. 31, 1993

[54] DUAL FREQUENCY CIRCULARLY POLARIZED MICROWAVE ANTENNA

[75] Inventor: Chich-Hsing A. Tsao, Saratoga, Calif.

[73] Assignee: Space Systems/Loral, Inc., Palo Alto, Calif.

[21] Appl. No.: 884,512

[22] Filed: May 15, 1992

[51] Int. Cl.[5] ..... H01Q 1/38

[52] U.S. Cl. ..... 343/700 MS; 343/848

[58] Field of Search ..... 343/700 MS, 846, 830, 343/848

[56] References Cited

U.S. PATENT DOCUMENTS

| | | | |
|---|---|---|---|
| 4,755,821 | 7/1988 | Itoh et al. | 343/700 MS |
| 4,843,400 | 6/1989 | Tsao et al. | 343/700 MS |
| 4,847,625 | 7/1989 | Dietrich et al. | 343/700 |
| 4,903,033 | 2/1990 | Tsao et al. | 343/700 MS |
| 4,990,927 | 2/1991 | Ieda et al. | 343/700 MS |
| 5,005,019 | 4/1991 | Zaghloul et al. | 343/700 MS |

OTHER PUBLICATIONS

Aksun, M. I., Chuang S. L., and Lo, Y. T., "Theory and Experiment of Electromagnetically Excited Microstrip Antennas for Circular Polarization Operation," 1989 IEEE AP-S International Symposium vol. II, Antennas and Propagation, Jun. 26-30,1989, pp. 1142-1145.

Aksun, M. I., Wang, Z. H., Chuang, S. L. and Lo, Y. T., "Ciruclar Polarization Operation of Double-Slot Fed Microstrip Antennas," 1989 IEEE AP-S International Symposium vol. II, Antennas and Propagation, Jun. 26-30, 1989, pp. 640-643.

Iwasaki, H. and Kawabata, K., "A Circularly Polarized Microstrip Antenna Using A Crossed-Slot Feed," 1990 Antennas and Propagation Symposium Digest, vol. II, May 7-11, 1990, pp. 807-810.

*Primary Examiner*—Michael C. Wimer

*Attorney, Agent, or Firm*—Edward J. Radlo

[57] ABSTRACT

An aperture coupled microwave antenna (10) for processing circularly polarized signals. The antenna (10) comprises a first planar dielectric layer (22) upon which a conductive radiating patch (12) is mounted. Attached to the radiating patch (12) are tuning means (20, 72) for converting linearly polarized signals into circularly polarized signals. The tuning means preferably takes the form of conductive tuning stubs (20). Abutting an opposite face (23) of the first dielectric layer (22) is a conductive ground plane (24) having two orthogonal elongated apertures (26, 28). The radiating patch (12) is electromagnetically coupled, through the two elongated apertures (26, 28), to two input/output ports (48, 56) by two conductive feeding circuits (38, 40). Each of the feeding circuits (38, 40) interacts with only one of the elongated apertures (26, 28, respectively). The two feeding circuits (38, 40) and the elongated apertures (26, 28) are designed to operate in isolation. This allows the antenna (10) of the present invention to simultaneously process two signals having different frequencies.

9 Claims, 4 Drawing Sheets

DUAL FREQUENCY CIRCULARLY POLARIZED MICROWAVE ANTENNA

FIELD OF THE INVENTION

This invention relates to microwave antennas and more specifically to an aperture coupled microwave patch antenna capable of generating and receiving circularly polarized electromagnetic signals and operable at two distinct frequencies simultaneously.

BACKGROUND ART

In recent years, microwave antennas have been widely used in both communication and radar applications. Due to their wide use, microwave antennas have been the subject of much attention. In particular, patch antennas, especially those capable of circular polarization operation, have been heavily researched and studied. A number of theories and methods have been proposed for constructing a patch antenna capable of generating and receiving circularly polarized signals.

For example, U.S. Pat. No. 4,903,033 issued to Tsao et al. discloses a dual polarization microwave antenna capable of generating circularly polarized signals. This antenna comprises a radiating patch, a ground plane having crossed slot apertures placed under the radiating patch, two feeding circuits, and two ports. This reference shows two ways in which circular polarization can be achieved: (1) through the use of a meanderline polarizer; or (2) through the use of a hybrid coupler. According to the first method, a meanderline polarizer is imposed onto the radiating patch such that the meanderlines are offset substantially 45 degrees with respect to each of the slot apertures. The meanderline polarizer operates to convert dual orthogonal linearly polarized signals into circularly polarized signals. The resulting antenna using this method may be quite thick and bulky, however, because meanderline polarizers need to have a thickness of at least three quarters of the wavelength at the operating frequency. At an operating frequency in the L-band region, the polarizer may need to be as thick as 9 inches. This makes for an undesirably large microwave antenna. According to the second method, the two ports of the antenna may be attached to two branches of a hybrid coupler. The coupler serves to induce a 90 degree phase difference between the input signals to the two ports, thereby producing the 90 degree phase shift necessary for circular polarization operation. Although this configuration is effective, it is not favored because it requires the use of a hybrid coupler. Hybrid couplers are difficult to fabricate using integrated circuit fabrication techniques. Consequently, they add cost and complexity to the production of the antenna.

Iwasaki et al., "A Circularly Polarized Microstrip Antenna Using a Crossed-Slot Feed," 1990 *IEEE Antennas and Propagation Symposium Digest Volume II*, Dallas, Tex., May 7-11, 1990, pp. 807-810, describes a radiating patch antenna for generating circularly polarized signals having a ground plane with orthogonal crossed slot apertures. A feed circuit couples an input signal to the radiating patch through the intersection point of the two apertures and causes two orthogonal linearly polarized signals to be generated. The lengths of the apertures are specifically designed to be different such that their resonant frequencies are different. At a frequency between the resonant frequencies of the two apertures, the phase of one of the linearly polarized signals lags the phase of the other signal by 90 degrees. As a result, a circularly polarized signal is generated at that particular frequency. Although this method is effective for generating circularly polarized signals, it is difficult to design an antenna operable at a specific frequency using this method. The frequency at which circular polarization is achieved cannot be calculated with much precision. Consequently, it is necessary to adjust the lengths of the apertures a number of times before a working model is obtained. Each time an adjustment is made, a new ground plane has to be produced. This can become rather tedious and expensive. A more desirable antenna would be one in which the operable frequency can be adjusted and fine-tuned without having to produce a new ground plane with each adjustment.

Askun et al., "Theory and Experiment of Electromagnetically Excited Microstrip Antennas for Circular Polarization Operation," 1989 *IEEE AP-S International Symposium Digest*, Volume II, San Jose, CA, June 26-30, 1989, pp. 1142-1145, describes another method for achieving circular polarization operation wherein a ground plane having a single slot aperture is placed under a rectangular, preferably square radiating patch. The radiating patch is coupled to a feeding circuit through the slot aperture. Circular polarization operation is achieved by properly adjusting the following parameters: (1) the dimensions of the radiating patch and the slot aperture; (2) orientation of the slot with respect to the patch; and (3) the position of the slot relative to the patch. This method suffers from the same shortcomings as the above methods: namely, each time an adjustment is made, a new antenna has to be built. Designing an antenna operable at a specified frequency using this method would be difficult and costly.

Askun et al., "Circular Polarization Operation of Double-Slot Fed Microstrip Antennas," 1989 *AP-S International Symposium Digest*, Volume II, San Jose, CA, June 26-30, 1989, pp. 640-643, describes two other methods for attaining circular polarization operation. According to the first method, a ground plane having two orthogonal, non-intersecting slot apertures is placed beneath a radiating patch. Each of the slot apertures couples the radiating patch to a different branch of a hybrid coupler. The hybrid coupler provides the 90 degree phase shift necessary for circular polarization operation. As discussed above, however, hybrid couplers are not favored as means for producing circularly polarized signals. According to the second technique of this reference, circular polarization operation can be attained without the use of a hybrid coupler. A ground plane, having two slot apertures which intersect each other orthogonally at one of their respective ends, is placed beneath a radiating patch. The patch is electromagnetically coupled to a coaxial line through the intersection point of the two apertures. A single signal on the coaxial line excites the radiating patch and causes the production of two linearly polarized orthogonal mode signals. By properly adjusting the dimensions of the patch, the dimensions of the slot apertures, and the location of the slots relative to the patch, it is possible to cause one of the produced signals to lag the other by 90 degrees, thereby creating a circularly polarized signal. Like the other antennas discussed above, however, it is difficult to design this antenna to operate at any particular frequency.

U. S. Pat. No. 4,843,400 issued to Tsao et al. describes another slot coupled antenna for generating circularly polarized signals. In the Tsao patent, a radiating patch is coupled to a feeding circuit through an elongated slot aperture. The radiating patch may take the shape of an ellipse or a near square. Depending upon the type of radiating patch used, the slot aperture is positioned such that it lies substantially along one of the diagonals of the near square patch or such that it makes a 45 degree angle with both the major and minor axes of the ellipse. The strategic placement of the slot relative to the patch causes the generation of two orthogonal components of electromagnetic energy. By experimentally adjusting the dimensions of the patch and the dimensions of the slot aperture, it is possible to cause the phase of one of the generated signals to lag the other by 90 degrees; thus, circular polarization operation is achieved. This antenna is difficult to design, however Other references are U.S. Pat. Nos. 4,755,821 and 4,847,625.

Thus, although a number of microwave antennas exist which are capable of circular polarization operation, none are altogether satisfactory. Most are difficult to design while others require the use of clumsy polarizers and hybrid couplers. Therefore, there is a need for an improved circular polarization microwave antenna.

DISCLOSURE OF INVENTION

The present invention is an aperture coupled microwave antenna capable of generating circularly polarized signals. According to the invention, the antenna comprises a conductive radiating patch (12) mounted upon the top face of a first planar dielectric layer (22). Attached to the sides of the patch (12) are conductive tuning stubs (20) which induce a 90 degree phase differential between dual linearly polarized signals to convert them into a circularly polarized signal. Attached to the bottom face of the dielectric layer (22) is a conductive ground plane (24) having two orthogonal elongated apertures (26, 28) (see FIG. 2). It is through the apertures (26, 28) that electromagnetic signals are coupled to the radiating patch (12). The invention further comprises feeding means which includes a second dielectric layer (30), a third dielectric layer (32) having two conductive feed networks (38, 40) mounted on opposite faces, a fourth dielectric layer (34), and a second ground plane (36).

The feeding means electromagnetically couples the radiating patch (12) to the input/output ports (48, 56) of the antenna. Due to the unique structure of the feed networks (38, 40) and the apertures (26, 28), two signals having different frequencies may be processed by the invention simultaneously. Thus, the invention is capable of dual frequency operation as well as circular polarization operation.

BEST MODE FOR CARRYING OUT THE INVENTION

Figure 1:
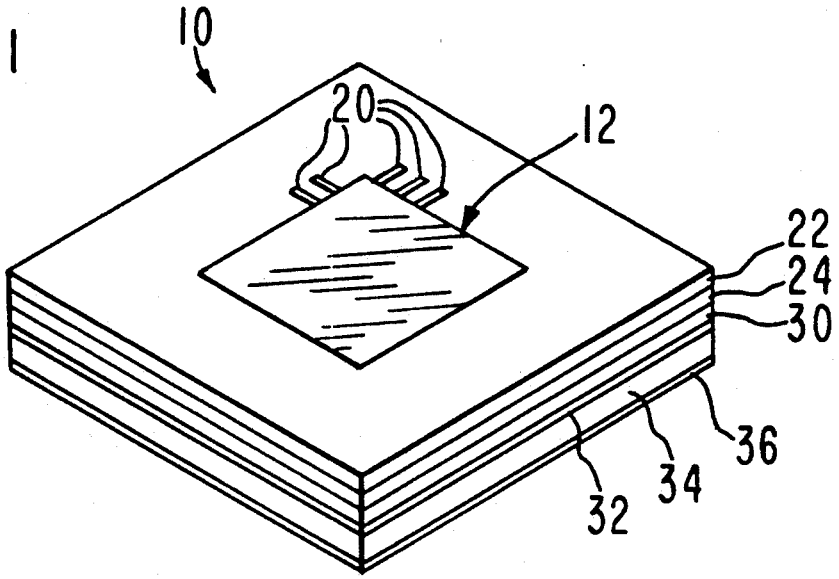
FIG. 1 is a perspective view of a preferred embodiment of the antenna 10 of the present invention.
Figure 2:
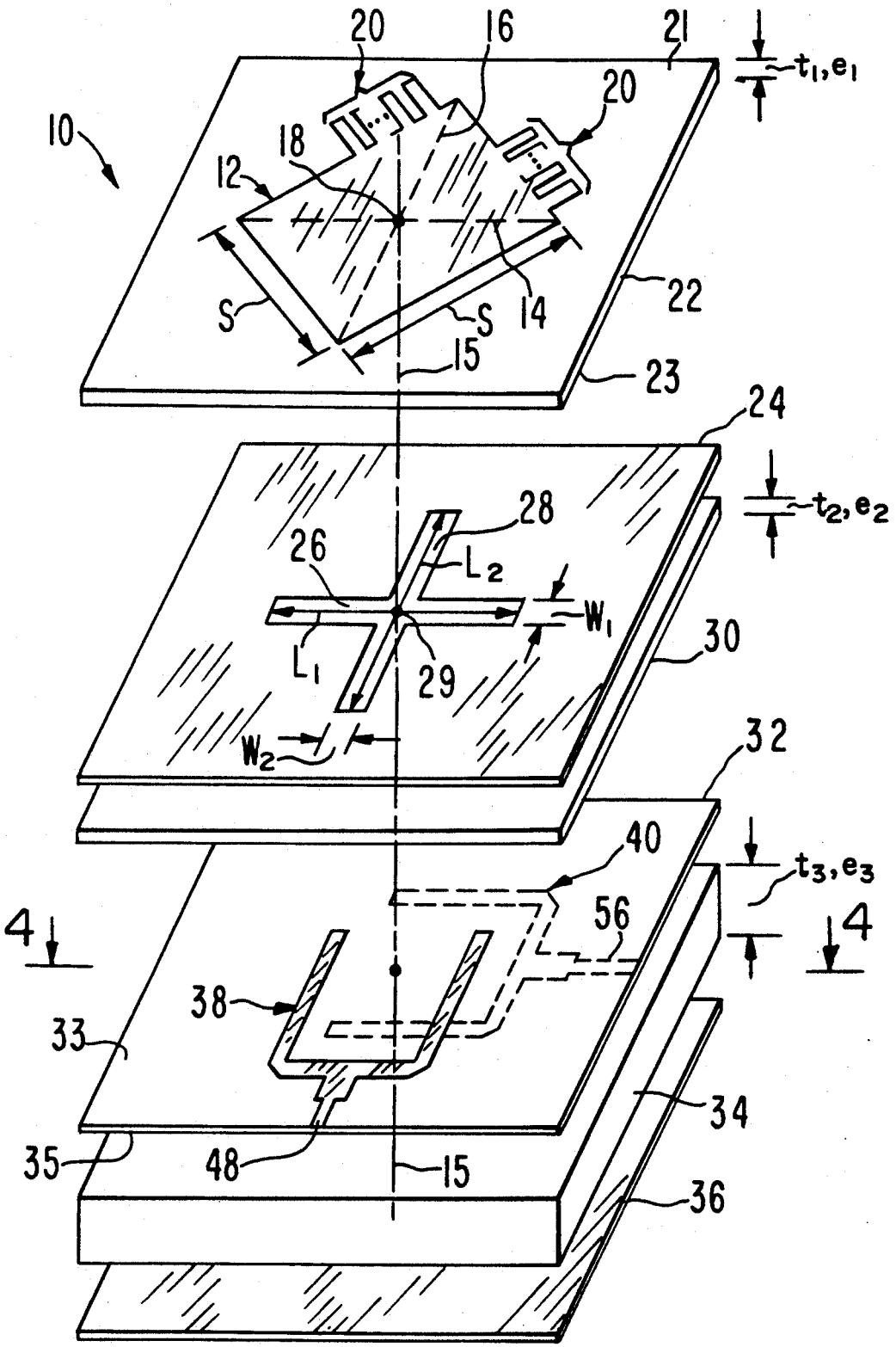
FIG. 2 is an exploded perspective view of the antenna 10 of FIG. 1.

A perspective view of a preferred embodiment of the present invention is provided in FIG. 1, and an exploded view is shown in FIG. 2. The antenna 10 comprises a radiating patch 12 mounted upon a dielectric layer 22, a ground plane 24 having two orthogonal elongated apertures 26 and 28, and feeding means comprising some or all of layers 30, 32, 34, and 36. All of the layers of the antenna 10 are substantially planar and are stacked one upon the other to form a single integrated antenna 10.

With reference to FIG. 2, the radiating patch 12, constructed of a conductive material such as copper, is mounted upon the top face 21 of a dielectric layer 22 having a thickness $t_1$ and a dielectric constant $e_1$. In the preferred embodiment, dielectric layer 22 is a honeycomb dielectric composed of the material Nomex. Radiating patch 12 preferably takes the shape of a square with each side having a dimension S. The two diagonal coplanar axes 14 and 16 of the square patch 12 intersect each other at the center 18 of the square. A vertical axis 15 orthogonal to the plane of layer 22 passes through the center 18 of the square patch 12.

Extending from the sides of the patch 12 are conductive tuning stubs 20 which serve to convert dual linearly polarized signals into a circularly polarized (CP) signal and vice versa. In transmit mode, tuning stubs 20 cause the phase of one of the linearly polarized signals to either lead or lag the phase of the other signal by 90 degrees, thereby producing the 90 degree phase difference needed for CP operation. Depending on which signal leads the other in phase, the sense of polarization of the CP signal will either be righthanded or lefthanded. The sense of polarization is controlled by the positioning and the dimensions of the tuning stubs 20. In receive mode, tuning stubs 20 serve to extract the phase difference from a CP signal to produce two linearly polarized signals which are in phase. The design and operation of tuning stubs 20 will be described in further detail below.

Figure 3:
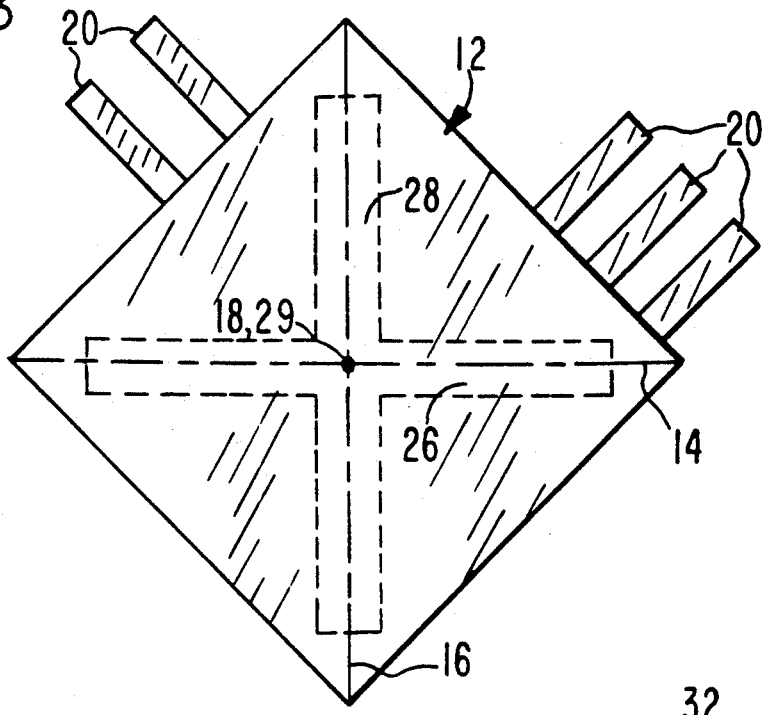
FIG. 3 is a top plan view of the radiating patch 12 and the underlying apertures 26, 28 of the invention showing their relative positioning.

Abutting the bottom face 23 of dielectric layer 22 is conductive ground plane 24 having two elongated apertures 26, 28. Aperture 26 has a length $L_1$ and a width $W_1$. Aperture 28 has a length $L_2$ and a width $W_2$. The two apertures 26, 28 intersect each other orthogonally at their respective midpoints 29 to form a cross-like structure. Ground plane 24 is placed beneath dielectric layer 22 and positioned such that vertical axis 15 passes through the midpoints 29 of the apertures 26, 28; and each of the apertures 26, 28 lies parallel to one of the diagonal axes 14, 16 of the square radiating patch 12. This is illustrated more clearly in FIG. 3. The apertures 26, 28 (shown by the dashed lines) are placed directly beneath the radiating patch 12 such that their midpoints 29 are vertically aligned with the center 18 of the radiating patch 12. In addition, aperture 26 lies parallel to diagonal axis 14, and aperture 28 lies parallel to diagonal axis 16. Positioned in this manner, each of the apertures 26, 28 forms an angle substantially 45 degrees with each of the sides of the radiating patch 12. As will be discussed later, this 45 degree angle plays an important role in the proper functioning of the invention.

Referring again to FIG. 2, the radiating patch 12, the dielectric layer 22, and the ground plane 24 discussed thus far form the radiator portion of the antenna 10. The dielectric layer 22 serves as the substrate for the radiator while the radiating patch 12 and the ground plane 24 form the radiating cavity in which electromagnetic signals are generated. The radiator is electromagnetically coupled to the external environment through one or both of the slot apertures 26, 28 in the ground plane 24. For this reason, this type of antenna is referred to as an aperture coupled antenna.

To electromagnetically couple the radiator portion of the invention to the external world, a feeding means is necessary. In the preferred embodiment, this feeding means takes one of two forms. With reference to FIG. 2, a first form of the feeding means comprises a dielectric layer 30 (such as a Nomex honeycomb dielectric) having a thickness $t_2$ and a dielectric constant $e_2$, and a thin dielectric layer 32 abutting layer 30. Layer 32 has a first microstrip feed network 38 on its top face 33, and a second microstrip feed network 40 orthogonal to the first network 38 on its bottom face 35. This is illustrated more clearly in FIG. 4, wherein feed network 38 is drawn with solid lines to show that it is mounted upon the top face 33 of dielectric layer 32 while feed network 40 is drawn in dashed lines to show that it resides on the opposite (bottom) face 35 of layer 32. Also indicated by broken lines in FIG. 4 is the projection of the aperture slots 26, 28 onto the plane of layer 32.

Figure 4:
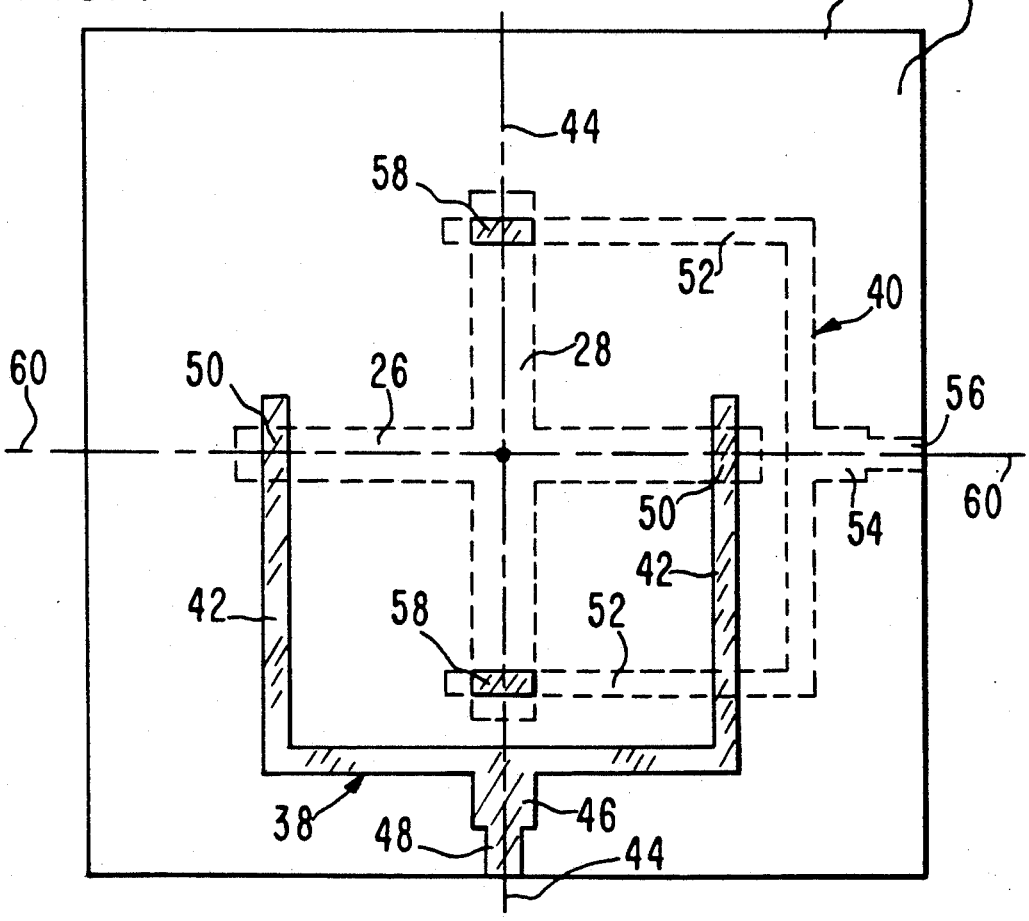
FIG. 4 is a plan view of the preferred feed networks 38, 40 of the taken along view lines 4—4 of FIG. 2.

With reference to FIG. 4, the first feed network 38 preferably comprises two elongated conductive microstrip elements 42 placed in parallel to each other and equidistant from a center plane 44. Center plane 44 is orthogonal to the plane of dielectric layer 32 and bisects the projection of aperture 26. Microstrip elements 42 extend into the middle portion of layer 32 to orthogonally intersect and overlap the projection of aperture 26 in two separate locations 50. The areas of overlap 50 will be referred to as coupling overlaps 50. Joining the two microstrip elements 42 and electromagnetically coupling them to input/output port 48 is power combiner 46. Power combiner 46 serves either to combine two signals propagating on elements 42 into a single signal or to separate a signal at the input/output port 48 into two equal power signals allowing each to propagate down a corresponding element 42. The entire feed network 38, which may be constructed of a conductive material such as copper or gold, is symmetric about center plane 44.

The second feed network 40, residing on the opposite face 35 of layer 32, is almost identical to the first feed network 38. Feed network 40 comprises a pair of elongated conductive microstrip elements 52 placed in parallel to each other. The two elements 52 are coupled to each other and to input/output port 56 by power combiner 54. The microstrip elements 52 extend into the middle section of layer 32 and intersect the projection of aperture 28 orthogonally at two distinct locations forming two coupling overlaps 58. Dividing the feed network 40 into two symmetrical portions is center plane 60 which is orthogonal to both the plane of layer 32 and the center plane 44 of the first feed network 38. Center plane 60 also bisects the projection of aperture 28. The intersection of the two center planes 44, 60 forms the vertical axis 15 (FIG. 2) of the antenna. A feeding means as thus far described comprising layers 30 and 32 forms a microstrip line feed circuit.

In a second embodiment of the feeding means of the invention, there is another dielectric layer 34 (FIG. 2) having a thickness $t_3$ and a dielectric constant $e_3$, abutting the lower face 35 of layer 32, and a second conductive ground plane 36 abutting layer 34. Dielectric layer 34 again may be a honeycomb dielectric made of Nomex. A feeding means in this form is called a strip line feed circuit. Both the microstrip line and the strip line feed circuits as described will function adequately as feeding means for the present invention.

By abutting dielectric layer 30 against the bottom of the first ground plane 24, the radiator portion of the antenna 10 is joined with the feeding means of the antenna 10 to form the complete aperture coupled antenna 10. By virtue of being aperture coupled, antenna 10 of the present invention has several inherent advantages. First, aperture coupled antennas can be easily fabricated using integrated circuit techniques. As a result, they can be made to have relatively low profiles. They also are relatively light in weight. In addition, because there is no direct coupling between the radiator and the feeding means, no probe soldering is necessary. While these advantages are inherent in all aperture coupled antennas, the present invention has other unique advantages. The operation of the invention will now be described.

The antenna 10 of the present invention is capable of operating in both transmit and receive mode. Since the operation in receive mode is simply the reverse of operation in the transmit mode, only the transmit mode will be described in detail. With reference to FIGS. 2 and 4, antenna 10, in transmit mode, receives an input signal at one of its input ports 48, 56. For the sake of discussion, it will be assumed that the input signal is received at port 48. The input signal enters antenna 10 at port 48 and propagates along port 48 until it encounters power combiner 46, at which time power combiner 46 separates the input signal into two half-signals with equal amplitude. Each of the half-signals propagates down a separate microstrip element 42 until it encounters its respective coupling overlap 50. The coupling overlaps 50 represent the portions of the microstrip elements 42 which lie directly beneath both the aperture 26 and the radiating patch 12. It is this overlap 50 which allows the half-signals to couple, through the aperture 26, to the radiating patch 12, and thus, enter the radiator of antenna 10.

Once inside the radiator portion, the half-signals excite the radiating patch 12 and cause it to generate electromagnetic signals having a frequency determined by the frequency of the input signal. Because of the 45 degree orientation of aperture 26 (FIG. 3) with respect to the sides of the radiating patch 12, two orthogonal field mode signals are generated, with both modes having substantially identical amplitude and phase. One of the requirements for CP operation is that two orthogonal field modes be generated with equal amplitude; thus, this requirement is satisfied. Each of the orthogonal modes generated is aligned with a pair of parallel sides of the radiating patch 12, and if tuning stubs 20 were not present, the two modes would combine to produce net radiation linearly polarized in a direction perpendicular to aperture 26. With properly designed tuning stubs 20, however, it is possible to cause the phase of one of the modes to lead or lag the phase of the other mode by 90 degrees without changing the amplitude of the modes. This results in the production of a CP signal. Depending upon which mode leads or lags the other in phase, the polarization of the signal will either be righthanded or lefthanded.

In the present invention, the dimensions and the positioning of the tuning stubs 20 primarily determine the sense of polarization of the signal as well as the frequency at which CP operation is achieved. However, the design of tuning stubs 20 is not an exact science. The number, the dimensions, and the positioning of the stubs 20 cannot be designed using equations, but rather must be determined experimentally. In this respect, the invention is like prior art CP antennas. But unlike prior art antennas, the present invention can be fine tuned to operate at a specific frequency without having to produce a new antenna 10 with each adjustment.

To elaborate, the general operating frequency range of a patch antenna is determined by the dimensions of the apertures 26, 28; the dimensions of the radiating patch 12; and the thickness and dielectric constants of the dielectric layers. However, within that general frequency range, there are a large number of frequencies at which CP operation may be desired. The prior art devices seek to accommodate CP operation at a particular frequency by specifically designing the integral elements of the antenna, such as the apertures in the ground plane. As a result, if a prior art antenna fails to achieve CP operation at the specified frequency, another antenna with different specifications must be built. Even if the adjustment is slight, it is still necessary to rebuild the antenna because an integral element of the antenna has to be altered. This is clumsy and expensive, and an unsatisfactory way of solving the problem of designing antennas to operate at a specific frequency.

Figure 5:
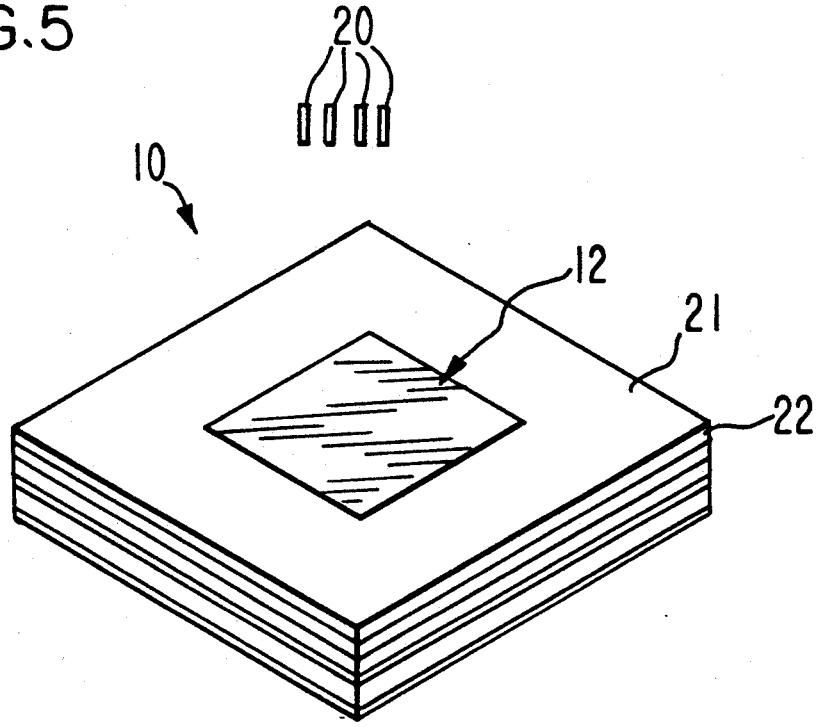
FIG. 5 is a perspective view of an integrated microwave antenna 10 in the process of being constructed.

In contrast, CP operation in the present invention is governed primarily by the tuning stubs 20. Tuning stubs 20 are not integral elements of antenna 10; thus, they may be adjusted without building an entirely new antenna. To design an antenna 10 to achieve CP operation at a particular frequency, one begins with an integrated antenna 62 like that shown in FIG. 5, which is an antenna substantially identical to that shown in FIG. 1 except that no tuning stubs 20 are present. As stated previously, without the tuning stubs 20, antenna 62 is able to generate only linearly polarized signals. The design of the stubs 20 begins by placing a set of removable planar conductive stubs 20 onto the top face 21 of dielectric layer 22. Removable stubs 20 may be made of a conductive material such as copper. Stubs 20 should be placed such that they lie flat on top of layer 22, and are positioned such that each stub 20 contacts one of the sides of the radiating patch 12. The number, the size, and the positioning of the stubs 20 are all parameters chosen by the designer. The stubs 20 may all be placed on only one side of the patch 12, or they may be placed on a plurality of sides. After the stubs 20 have been placed upon layer 22, measurements should be taken to ascertain whether CP operation has been achieved and whether it takes place at the proper frequency. If not, stubs 20 can be moved, other stubs 20 may be added, or different sized stubs 20 can be employed. After several iterations, a working model should be obtained. Once the number, size, and locations of the stubs 20 are known, a permanent integrated antenna like that shown in FIG. 1 can be constructed.

The entire design process thus requires only one basic antenna 10. No new antenna 10 needs to be built for any of the adjustments. In fact, the same basic antenna 10 may be used to design a plurality of antennas 10 so long as the desired CP operating frequency is within the general operating frequency range of the basic antenna 10. Thus, the antenna 10 of the present invention can be designed much more easily, efficiently, and cost effectively than the antennas of the prior art.

Another advantage of the invention is that it is capable of dual frequency operation; that is, the invention is operable at two different frequencies simultaneously. Dual frequency operation is quite desirable because it essentially allows a single antenna 10 to do the work of two. This, in turn, reduces the number of antennas 10 needed for any particular application. Dual frequency operation is made possible by the special configuration of the antenna 10. With reference to FIG. 2, the feed networks 38, 40 are designed to lie orthogonal to each other and on opposite sides of dielectric layer 32, to electromagnetically isolate one from the other. Also, the apertures 26, 28 in ground plane 24 are placed orthogonal to each other to ensure that they function separately with minimal interaction. In addition each of the feed networks 38, 40 is strategically placed relative to the apertures 26, 28 such that each network 38, 40 interacts with only one of the apertures 26, 28. All of these features in combination enable the antenna 10 to operate at two different frequencies simultaneously while keeping the two frequencies separate. In essence, the present invention is two antennas 10 in one. This dual frequency capability greatly enhances the versatility of the invention and allows it to accommodate many different uses.

For example, the antenna 10 of the present invention may be used to simultaneously generate CP signals at two distinct frequencies. This can be accomplished by attaching two sets of tuning stubs 20 to the radiating patch 12, with each set of stubs 20 designed to achieve CP operation at a different frequency. This is possible because tuning stubs 20 are very high Q devices. That is, they will affect only those signals which are within a very narrow frequency range. Signals outside this range will not be significantly affected. Therefore, as long as the two frequencies at which CP operation is desired are sufficiently far apart, the first set of stubs 20 will not affect the frequencies affected by the second set of stubs 20, and vice versa. As a result, frequency isolation is achieved between the two sets of stubs 20, and two CP signals having different frequencies can be produced.

The invention is also capable of simultaneously generating a CP signal and a linearly polarized signal. This may be accomplished by attaching only one set of tuning stubs 20 to the radiating patch 12. The one set of tuning stubs 20 will convert linearly polarized signals at the proper frequency to CP signals. However, as previously mentioned, tuning stubs 20 will affect only those signals within a narrow frequency range. Where a linearly polarized signal is generated having a frequency sufficiently outside the range of effect of the tuning stubs 20, that signal remains a linearly polarized signal. The result is that both CP and linearly polarized signals may be generated by the same antenna 10.

Another capability of the invention 10 is that it can transmit and receive signals at the same time. The uses for the invention 10 thus far described are only examples of some of the capabilities of the invention 10. Other implementations will be apparent to those skilled in the art.

Figure 6:
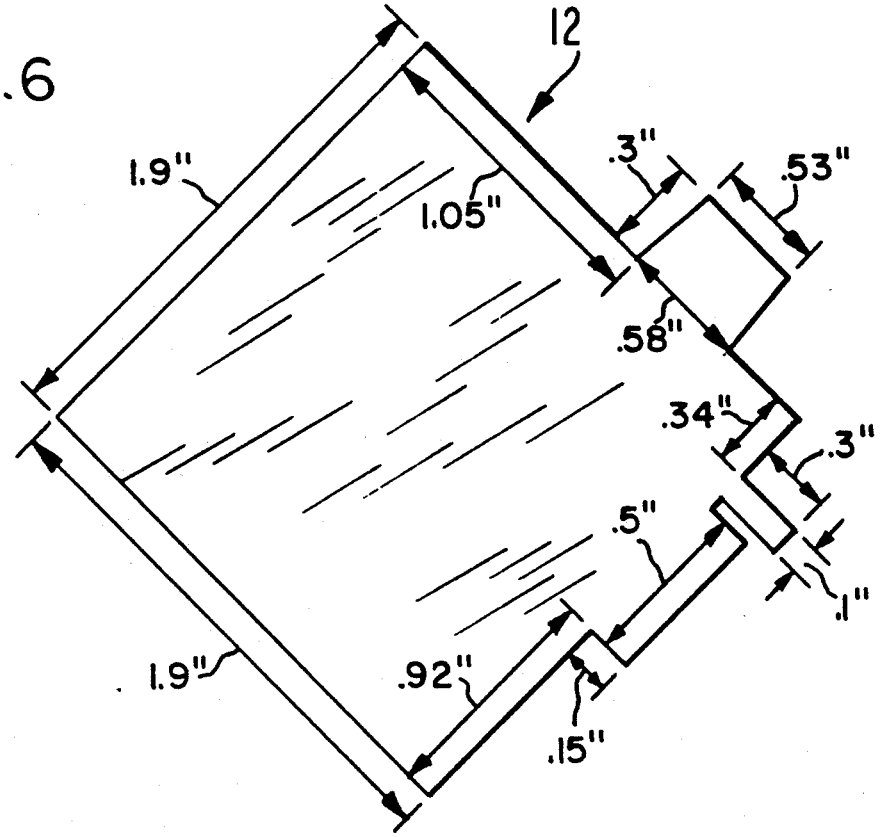
FIG. 6 is a plan view of the radiating patch 12 of a specific implementation of the invention.

To further illustrate the invention 10, a working model of antenna 10 will now be disclosed. With reference to FIGS. 2 and 6, a practical implementation of the invention 10 comprises the radiating patch 12 shown in FIG. 6 mounted upon dielectric layer 22, ground plane 24, dielectric layer 30, and dielectric layer 32 having feed networks 38, 40. Dielectric layers 22 and 30 are honeycomb dielectrics made of the material Nomex. Because layers 22, 30 are honeycomb dielectrics, their dielectric constants $e_1$, $e_2$ are substantially equal to 1. The dimensions of the antenna are as follows:

| | |
|---|---|
| $L_1$ = 1.64 inches; | $L_2$ = 1.5 inches; |
| $W_1$ = .05 inches; | $W_2$ = .05 inches; |
| $t_1$ = .185 inches; and | $t_2$ = .06 inches. |

The dimensions of radiating patch 12 are shown in FIG. 6. This particular antenna 10 achieves circular polarization at two frequencies: (1) 2.0 GHz; and (2) 2.34 GHz. It can accommodate both of these frequencies simultaneously.

Figure 7:
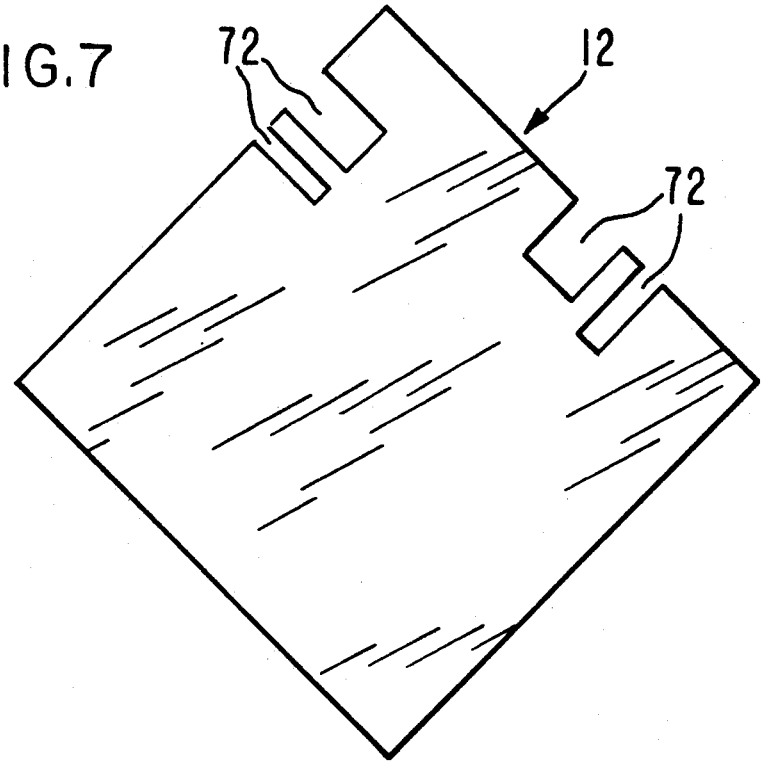
FIG. 7 is a plan view of an alternate embodiment of the radiating patch 12 of the invention.

Although the invention 10 has been described with reference to a preferred embodiment, the scope of the invention 10 should not be construed to be so limited. Many modifications may be made by those skilled in the art with the benefit of this disclosure without departing from the spirit of the invention 10. For example, the 90 degree phase shift necessary for CP operation may be obtained by using notches cut into the radiating patch instead of tuning stubs 20. This is illustrated in FIG. 7, wherein a plurality of notches 72 are cut from the sides of radiating patch 12. Depending upon the number of notches 72, their dimensions, and their positioning, CP operation may be achieved at various frequencies. These and other changes may be made within the spirit of the invention. Therefore, the invention should not be limited by the specific examples used to illustrate it but only by the scope of the appended claims.

What is claimed is:

1. A microwave antenna comprising (a) a substantially planar dielectric layer having a top and a bottom face;

(b) a substantially planar conductive radiating patch having a plurality of sides mounted on the top face of the dielectric layer;

(c) a substantially planar conductive ground plane having at least one aperture, abutting the bottom face of the dielectric layer;

(d) tuning means electrically connected to the radiating patch for converting two linearly polarized orthogonal field mode signals into circularly polarized signals and vice versa;

(e) an input/output port; and (f) feeding means for electromagnetically coupling the port to the radiating patch through a selected portion of the aperture;

wherein the radiating patch is substantially a square having a center, and further having two coplanar diagonal axes passing through the center;

wherein the aperture in the ground plane is an elongated aperture having a midpoint, and the aperture is positioned parallel to one of the diagonal axes of the radiating patch such that the midpoint of the aperture is aligned with the center of the patch along an axis that is perpendicular to both the patch and the ground plane.

2. The microwave antenna of claim 1, wherein the tuning means comprises a plurality of conductive tuning stubs which are attached to and extend from the radiating patch.

3. The microwave antenna of claim 1, wherein the tuning means comprises a plurality of notches cut into the radiating patch.

4. A microwave antenna operable at two different frequencies simultaneously, comprising:

(a) a first substantially planar dielectric layer having a top face and a bottom face;

(b) a substantially planar, square conductive radiating patch mounted on the top face of the dielectric layer, having a center and two coplanar diagonal axes passing through the center;

(c) a first substantially planar conductive ground plane abutting the bottom face of the dielectric layer, having first and second elongated apertures which intersect each other at their respective midpoints and which are positioned orthogonal to each other, the ground plane being positioned such that the midponts of the apertures are aligned with the center of the patch along an axis that is perpendicular to both the patch and the ground plane, and each of the apertures is parallel to one of the diagonal axes of the radiating patch;

(d) tuning means electrically connected to the patch for converting two linearly polarized orthogonal field mode signals into circularly polarized signals and vice versa;

(e) a second substantially planar dielectric layer having a top face contacting the ground plane, and a bottom face; and (f) a third substantially planar dielectric layer having a top face and a bottom face, with a first conductive planar feed network attached to the top face, and a second conductive planar feed network attached to the bottom face, the top face of the third dielectric layer being attached to the bottom face of the second dielectric layer; wherein the first feed network is symmetric about a first center plane which is orthogonal to the ground plane, to the radiating patch, and to the third dielectric layer, and which bisects the first aperture, said first feed network comprising at least two elongated substantially identical parallel conductive microstrip elements positioned equidistant from the first center plane, the microstrip elements being positioned so as to orthogonally intersect a projection of the first aperture onto the plane of the third dielectric layer in at least two distinct locations; and the second feed network is symmetric about a second center plane which is orthogonal to the ground plane, to the radiating patch, to the third layer, and to the first center plane, and which bisects the second aperture, said second feed network comprising at least two elongated substantially identical parallel conductive microstrip elements positioned equidistant from the second center plane, the microstrip elements being positioned so as to orthogonally intersect a projection of the second aperture onto the plane of the third dielectric layer in at least two distinct locations.

5. The antenna of claim 4, wherein the tuning means comprises a plurality of conductive tuning stubs which are attached to and extend from the radiating patch.

6. The antenna of claim 4, wherein the tuning means comprises a plurality of notches cut into the radiating patch.

7. The antenna of claim 4, further comprising:

a fourth substantially planar dielectric layer having a first face abutting the bottom face of the third dielectric layer, and a second face; and a second substantially planar conductive ground plane abutting the second face of the fourth dielectric layer.

8. The antenna of claim 7, wherein the tuning means comprises a plurality of conductive tuning stubs which are attached to and extend from the radiating patch.

9. The antenna of claim 7, wherein the tuning means comprises a plurality of notches cut into the radiating patch.

* * * * *